US005214813A

United States Patent [19]

Gastle et al.

[11] Patent Number: 5,214,813

[45] Date of Patent: Jun. 1, 1993

[54] PATIENT SUPPORT DEVICE

[76] Inventors: Thomas H. Gastle; James E. Gastle, both of P.O. Box 430, Lakefield, Ontario, K0L-2H0, Canada

[21] Appl. No.: 889,964

[22] Filed: May 29, 1992

Related U.S. Application Data

[63] Continuation-in-part of Ser. No. 731,661, Jul. 17, 1992.

[51] Int. Cl.[5] ..... A61G 1/00

[52] U.S. Cl. ..... 5/625

[58] Field of Search ..... 5/625, 627, 628; 383/10; 294/140, 152; 224/158

[56] References Cited

U.S. PATENT DOCUMENTS

| | | | |
|---|---|---|---|
| 2,351,146 | 6/1944 | Pike | 5/625 |
| 2,835,902 | 5/1958 | Fash | 5/627 |
| 2,899,692 | 8/1959 | Finken | 5/628 |
| 3,336,060 | 8/1967 | Bradford | 5/627 |
| 4,442,557 | 4/1984 | Clemens | 5/625 |
| 5,015,103 | 5/1991 | Mercer | 383/10 |
| 5,104,235 | 4/1992 | Bronstrup et al. | 383/10 |

*Primary Examiner*—Alexander Grosz

[57] ABSTRACT

A patient support device is disclosed having a flexible support means, the support means having a pair of ends each of which includes a pair of hand holds. The hand holds are formed by cut outs in each corner of the support means, each of the cutouts forming a flap that engages the palm of the user's hand when lifting a patient. Each of the cut outs is aligned with a respective cutout so that, during use, the hand holds may be nested together to form an integral handle with overlapping flaps. The support means is formed of reinforced sheet material having sufficient rigidity to enable the integral handle to resist collapse and is dimensioned to position the hand holds above a floor surface in order to minimize discomfort experienced by a user when lifting a patient.

6 Claims, 6 Drawing Sheets

PATIENT SUPPORT DEVICE

REFERENCE TO CO-PENDING APPLICATION

This application is a continuation in part of application Ser. No. 731,661 filed on Jul. 17, 1992.

BACKGROUND OF THE INVENTION

1. Field of the Invention

The present invention relates to patient support devices.

2. Description of the Related Art

There are several versions of patient support devices currently in use, including those referred to as 'stretchers'. Stretchers are available in three versions, the first being with a wheeled undercarriage and otherwise referred to as 'gurneys' and the second being a non-wheeled but otherwise rigid unit carried by two or more personnel.

The third version is referred to as a 'collapsible' stretcher, in the sense that it can be reduced to a size smaller than its operative size. Such stretchers have found favour in cases where space is limited, or where the stretcher is to be carried. While exiting collapsible stretchers are satisfactory for their intended purpose, there are situations where the conventional stretchers are inappropriate. There are limits to the minimum size that these stretchers can be collapsed into. Smaller size usually must give way to a carrying handle which is nothing more than a simple nylon strap. However, such straps tend to put unwanted lateral 'squeezing' pressure on the hand causing pain and hand fatigue.

It is therefore an object of the present invention to provide a novel patient support device.

SUMMARY OF THE INVENTION

Briefly stated, the invention involves a patient support device comprising a flexible support means, said support means having a pair of ends each of which includes a pair of hand holds, said hand holds being formed by cut outs in each corner of said support means, each of said cutouts forming a flap that engages the palm of the user's hand when lifting a patient, each of said cut outs being aligned with a respective cutout so that, during use, said hand holds may be nested together to form an integral handle with overlapping flaps, said support means being formed of reinforced sheet material having sufficient rigidity to enable said integral handle to resist collapse, said support means being dimensioned to position said hand holds above a floor surface in order to minimize discomfort experienced by a user when lifting a patient.

BRIEF DESCRIPTION OF THE DRAWINGS

Preferred embodiments of the present invention will now be described, by way of example only, with reference to the appended drawings in which:

FIG. 8 is a perspective view of yet another stretcher.

DESCRIPTION OF THE PREFERRED EMBODIMENTS

Referring to the figures, there is provided a flexible stretcher 120 formed of a reinforced flexible material such as polyester reinforced vinyl. The stretcher 120 has four corners, each of which is reinforced with a patch shown at 120*a*. The corner is further cut to form a hand hold 120*b*. The cut is made to form a folded flap which, in use, follows the inside contour of the hand thus allowing additional comfort. The user's hand will be wrapped around the fold so that the hand contacts the surface of the flexible material rather than the edge thereof.

Furthermore, the flap together with the patch forms a handle with a thickened cross section. The hand hold provides a relatively rigid handle to resist lateral pressure against the hand that would otherwise constrict the hand. However, with the flap in its unused position, the handle once again becomes sufficiently flexible to be folded for storage.

The flexible stretcher 120 has the particular feature of collapsing when carrying objects such as large animals, namely dogs, calves and the like. This collapsing effect serves to cradle the animal in the stretcher and to make it more difficult for the animal to fall off the stretcher. Further, the collapsing effect permits the user to begin the lift in a more upright position. It should also be pointed out that the stretcher is intended to be used with one person at each end so that the work required to lift the animal is cut in half.

Figure 3:
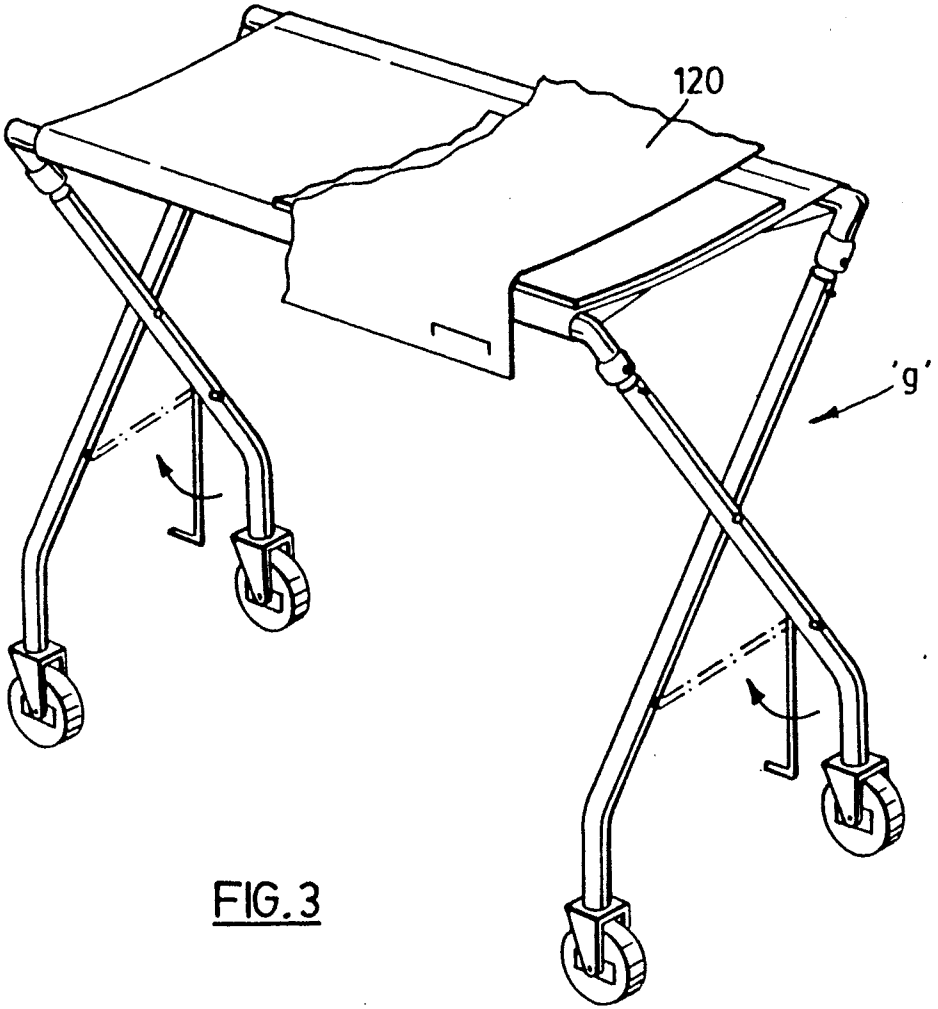
FIG. 3 is a perspective view of a gurney making use of the stretcher illustrated in FIG. 2.
Figure 6A:
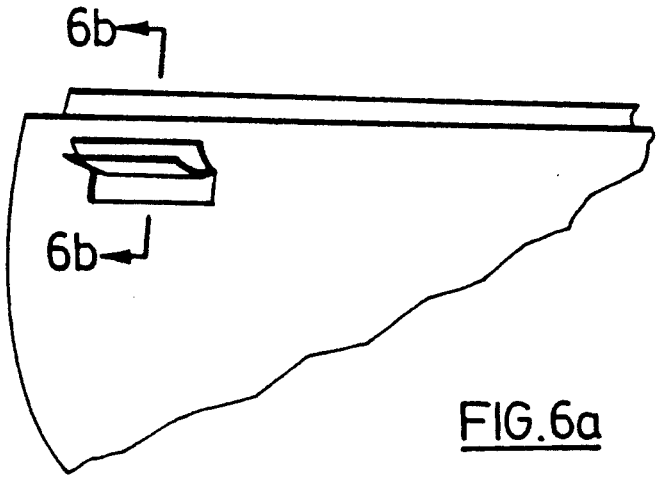
FIG. 6*a* is a fragmentary perspective view of a portion of the stretcher illustrated in FIG. 6.
Figure 6B:
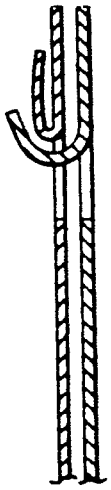
FIG. 6*b* is a sectional view taken on arrow 6*b* of FIG. 6*a;*

As shown in FIG. 3 the stretcher 120 is particularly useful in that it can be used to lift animals onto gurneys such as that shown at 'g' and to transfer animals from gurneys to other exam, x-ray and surgery tables with much less physical effort required.

Figure 1:
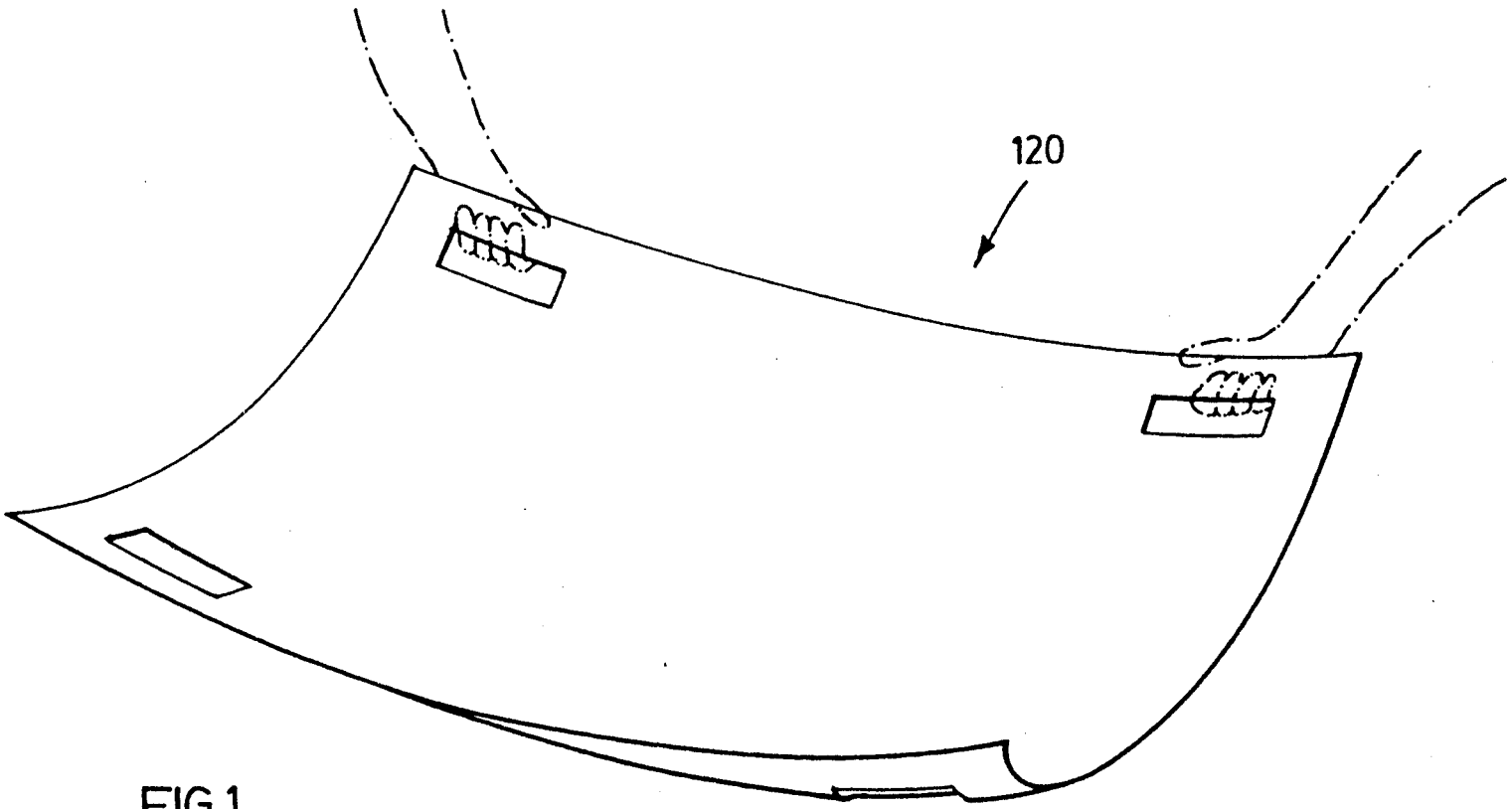
FIG. 1 is a perspective view of a stretcher.
Figure 2A:
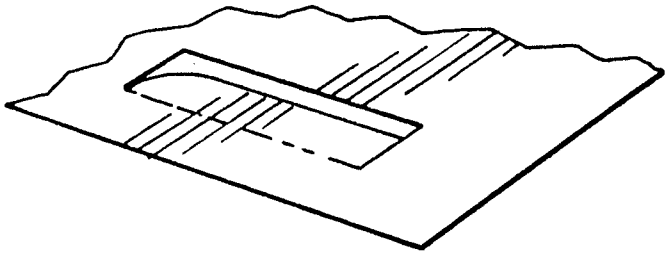
FIG. 2*a* is a fragmentary perspective view of one portion of the stretcher illustrated in FIG. 2.
Figure 2B:
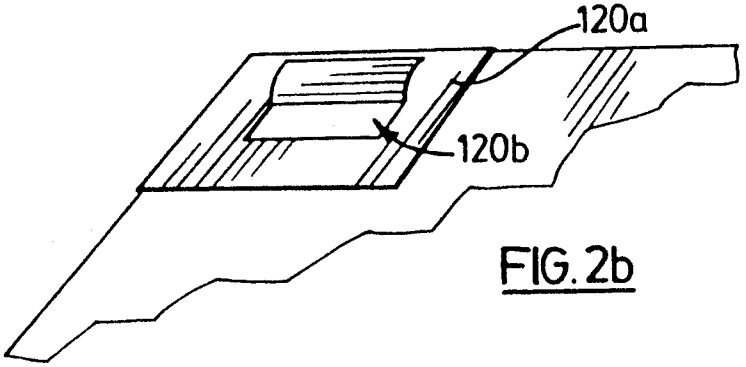
FIG. 2*b* is another fragmentary perspective view of the portion illustrated in FIG. 2*a;*
Figure 2:
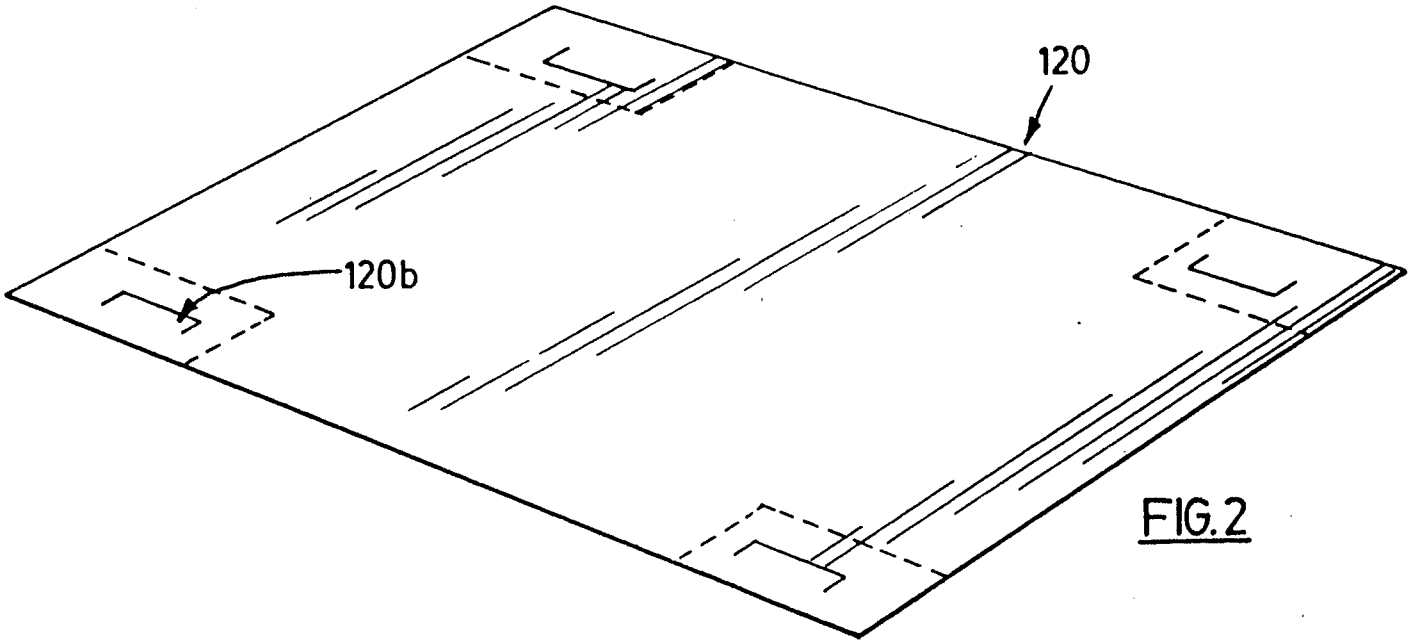
FIG. 2 is another perspective view of the stretcher illustrated in FIG. 1.
Figure 4:
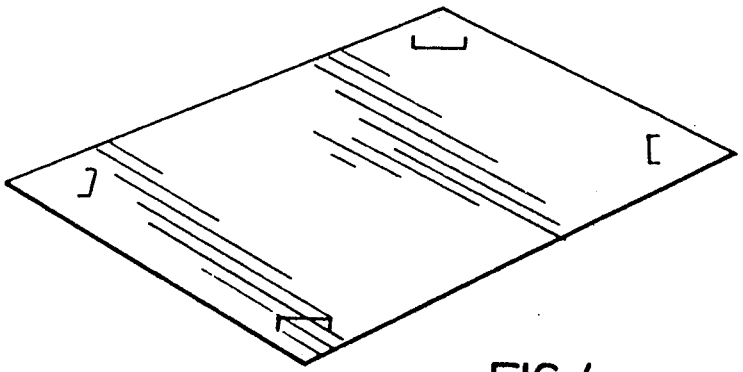
FIG. 4 is a perspective view of another stretcher.
Figure 5:
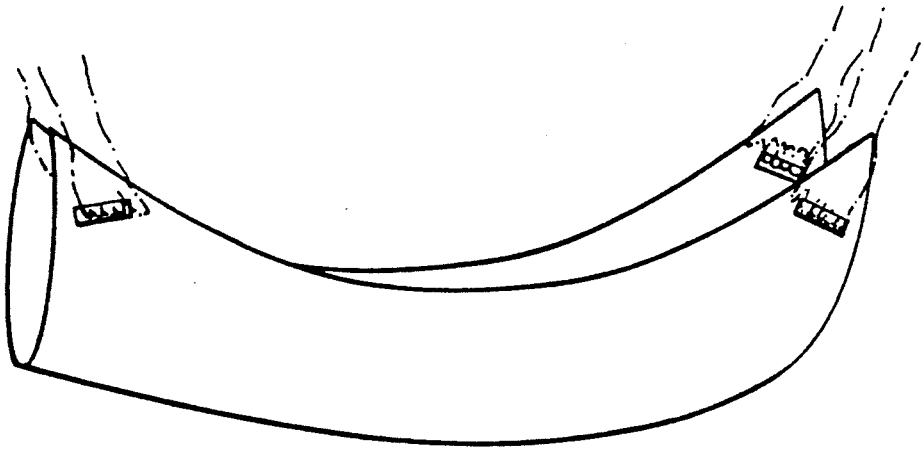
FIG. 5 is a perspective view of the stretcher illustrated in FIG. 4 in an operative position.

If desired, the hand holds may be formed on an angle as shown in FIGS. 4 and 5. In this case, the hand hold will be positioned to permit the hand to be in a natural gripping position rather than in an extended position as might be necessary with the hand hold not angled as in the previous embodiment.

Figure 6:
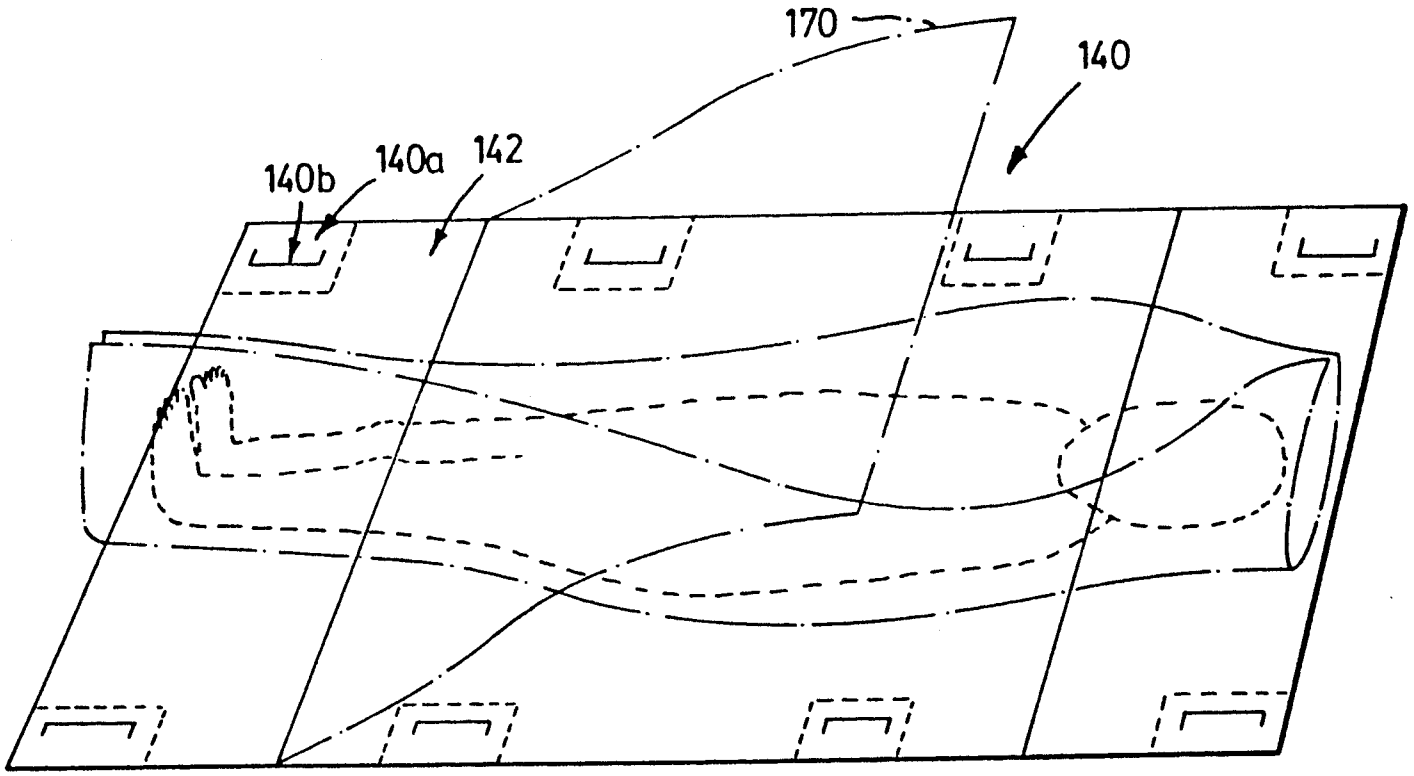
FIG. 6 is a perspective view of yet another stretcher with an operative position shown in phantom.
Figure 7:
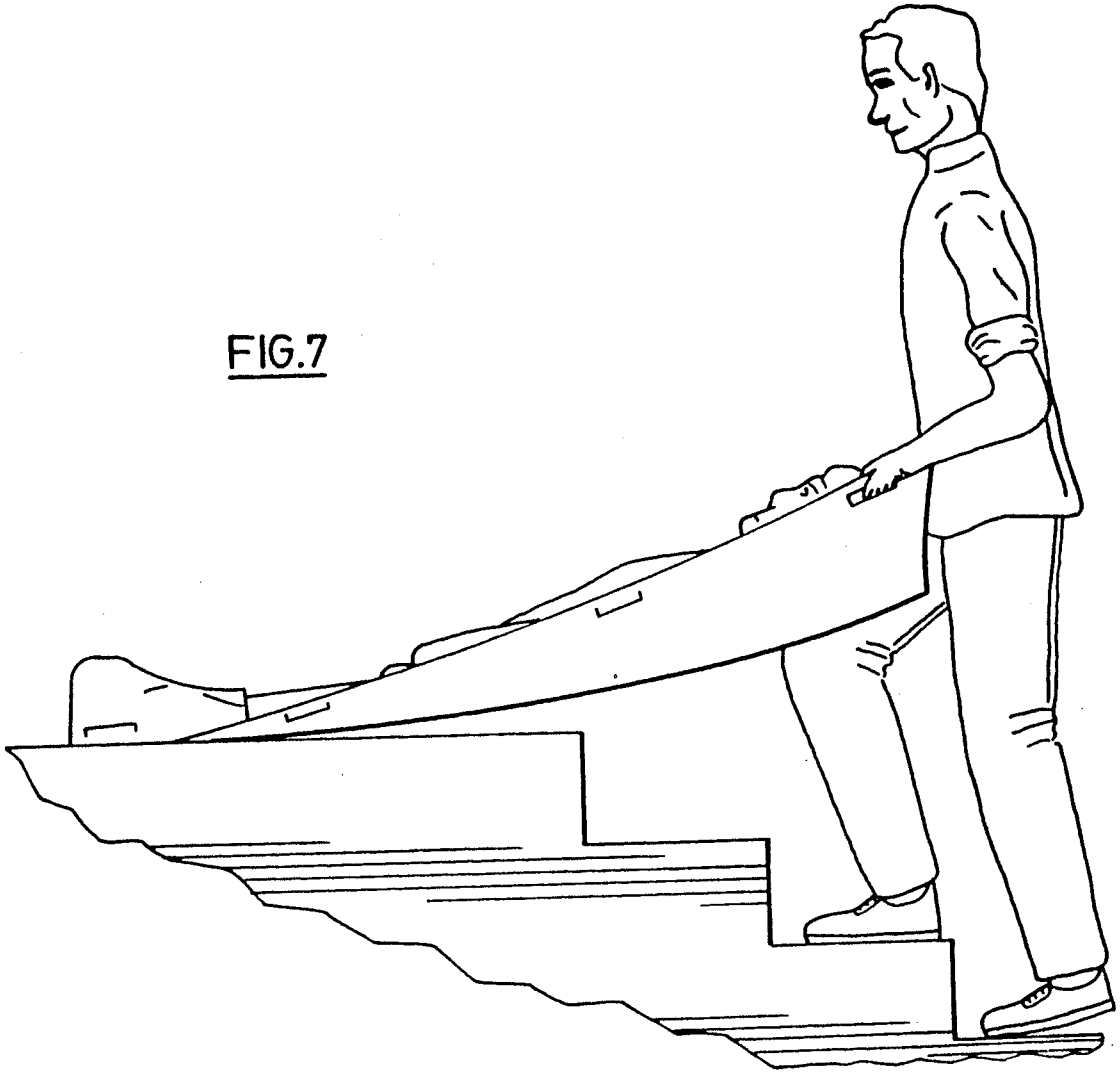
FIG. 7 is a side view of the stretcher illustrated in FIG. 6 in another operative position.

Referring to FIGS. 6 and 7 there is provided another flexible stretcher 140 formed of a reinforced flexible material such as polyester reinforced vinyl. The stretcher 140 has four corners, each of which is reinforced with a patch shown at 140*a*. The corner is further cut to form a hand hold 140*b*. The cut is made to form a folded flap to function as does the flap in the earlier embodiment. In addition, a number of other hand holds are provided to allow a number of rescue personnel to carry the stretcher side-by-side.

A particular feature of the stretcher 140 is the use of pockets 142 located at each end thereof and which are dimensioned to receive a portion of the patient to be carried in the stretcher, such as for example, the patient's feet. The pockets 142 at each end allow usage in impaired sight conditions and prevent the patient from slipping off the stretcher when being carried on an incline.

The stretcher 140 lends itself to be used either with two or more rescue personnel as shown for example in phantom in FIG. 6. In this case, the stretcher 140 may be used so that the hand holds can be nested with one another to permit the rescue personnel to carry the stretcher with one hand while using the other hand to negotiate stair wells and the like. The nesting feature can be seen in FIGS. *6a*, *6b* and forms a snug integral fit for the rescue personnel. In fact, the nesting tends to increase the strength of the hand hold by doubling the thickness of material that is folded, the fold forming a structure that resists collapse.

The stretcher 140 may also be used by a single rescuer as for example shown in FIG. 7. In this case, the rescuer can insert the patient's feet in one pocket which prevents the patient from slipping off the end of the stretcher. The rescuer may then grip the other end of the stretcher with the two hand holds and drag the patient along the floor. If stairs or other obstructions must be passed, the stretcher can maintain the buttocks and back off the floor to prevent injury while the feet will absorb the obstruction. If desired, the stretcher may also be provided with a cushion layer to protect the patient from such obstructions even further.

As with the stretcher 120, the stretcher 140 has the particular feature of collapsing when carrying a patient. This collapsing effect serves to cradle the patient in the stretcher and to make it more difficult for the patient to fall off the stretcher. Further, the collapsing effect permits the rescue personnel to begin the lift in a more upright position.

The handles lie flat in their unused position and thereby do not interfere with the folding of the stretcher for storage. The stretcher may be easily folded into a relatively small package thereby requiring relatively little storage space in an aircraft or other rescue vehicle. The rescuer may easily carry the stretcher on a belt-located pouch, in a pocket or the like and thereby not be hindered in his efforts to locate a victim.

Referring to FIG. 6, the stretcher 140 may also be provided with a cover portion 170 to provide heat retention, or protection against the elements for the patient. In this case, the cover portion may either be integral with or be attached to the pocket and be stored therein if desired.

Other restraint straps may of course be incorporated into the stretcher as desired.

While the above embodiments refer to patients, animals rescue and veterinary personnel, it will of course be understood that all of the above embodiments may be used in situations other than those specifically named.

We claim:

1. A patient support device comprising a flexible support means, said support means having a pair of ends each of which includes a pair of hand holds, said hand holds being formed by cut outs in each corner of said support means, each of said cutouts forming a flap that engages the palm of the user's hand when lifting a patient, each of said cut outs being aligned with a respective cutout so that, during use, said hand holds may be nested together to form an integral handle with overlapping flaps, said support means being formed of reinforced sheet material having sufficient rigidity to enable said integral handle to resist collapse, said support means being dimensioned to position said hand holds above a floor surface in order to minimize discomfort experienced by a user when lifting a patient.

2. A patient support device as defined in claim 1 wherein said support means includes at least one pocket located at one end of said support means to receive a body part of said patient.

3. A patient support device as defined in claim 2 wherein said support means includes a pair of said pockets, each of which is located at a respective end of said support means, said pockets being dimensioned to receive the lower extremities of said patient.

4. A patient support device as defined in claim 3 wherein each of said hand holds includes a reinforcement patch.

5. A patient support device as defined in claim 4 wherein said patch is formed from reinforced vinyl material.

6. A patient support device as defined in claim 2 further comprising a cover portion to provide heat retention for said patient.

* * * * *